US005807125A

United States Patent [19]

Edgley et al.

[11] Patent Number: 5,807,125

[45] Date of Patent: Sep. 15, 1998

[54] SYSTEM FOR MOUNTING AN ELECTRICAL CONNECTOR IN A SUPPORT STRUCTURE

[75] Inventors: Richard R. Edgley, Elmhurst, Ill.; William R. Lenz, Grand Marais, Minn.; John S. Luthy, Naperville; Karen Samiec, Downers Grove, both of Ill.

[73] Assignee: Molex Incorporated, Lisle, Ill.

[21] Appl. No.: 802,149

[22] Filed: Feb. 19, 1997

[51] Int. Cl.[6] ..... H01R 13/64

[52] U.S. Cl. ..... 439/248; 439/557

[58] Field of Search ..... 439/247, 248, 439/554, 557

[56] References Cited

U.S. PATENT DOCUMENTS

| | | | |
|---|---|---|---|
| 5,002,497 | 3/1991 | Plocek et al. | 439/248 |
| 5,044,986 | 9/1991 | Baumanis | 439/548 |
| 5,249,982 | 10/1993 | Funck et al. | 439/557 |
| 5,516,303 | 5/1996 | Yohn et al. | 439/248 |

FOREIGN PATENT DOCUMENTS

| | | | |
|---|---|---|---|
| 7-296903 | 11/1995 | Japan | H01R 13/74 |

*Primary Examiner*—Neil Abrams
*Assistant Examiner*—Katrina Davis
*Attorney, Agent, or Firm*—Stephen Z. Weiss

[57] ABSTRACT

A system is provided for mounting an electrical connector in a support structure. The connector includes a housing having a forward insertion end and a rearward mating end. The support structure includes an inner opening for receiving the forward insertion end of the housing and an outer opening for embracing the rearward mating end of the housing. A mounting structure provides limited floating movement of the mating end of the housing relative to the support structure to facilitate mating the connector with a complementary connector. The mounting structure at the insertion end of the housing fixed the insertion end of the housing against movement relative to the support structure.

16 Claims, 3 Drawing Sheets

SYSTEM FOR MOUNTING AN ELECTRICAL CONNECTOR IN A SUPPORT STRUCTURE

FIELD OF THE INVENTION

This invention generally relates to the art of electrical connectors and, particularly, to a system for mounting an electrical connector in a support structure wherein a mating end of the connector is provided with floating movement to facilitate mating with a complementary connector, such as in a blind mating application.

BACKGROUND OF THE INVENTION

Electrical connectors are used in a wide variety of applications generally to interconnect electrical conductors. For instance, a pair of mateable electrical connectors can be used to interconnect a pair of discrete electrical cables. Connectors are used to interconnect cables with printed circuit boards or even printed circuit boards with other printed circuit boards. Simply put, electrical connectors are used in a myriad of applications wherein it is desirable to interconnect a conductor of one electrical device or apparatus to a conductor of a second electrical device or apparatus.

Typically, an electrical connector includes a dielectric housing mounting a plurality of conductive terminals, the housing being mateable with the housing of a second electrical connector or other connecting device mounting terminals for interconnection with the terminals of the first connector. For instance, a plug connector might be mateable with a receptacle connector wherein one of the connectors mounts male terminals and the other connector mounts female terminals.

In some applications, electrical connectors are very easy to mate with one another because they can be visibly aligned and manually mated. However, in other applications it may be very difficult to mate a pair of connectors because of lack of visibility during mating. The latter applications often are called "blind mating" conditions. For instance, one connector might be mounted and fixed in a support structure, and, in blind mating conditions, it is very difficult to align the second connector with the first connector because the operator cannot see the other connector. In other applications, a pair of connectors may be respectively mounted in a pair of support structures which, in turn, are moved toward each other to automatically mate the connectors, and the larger support structures are not always precisely aligned as is required in aligning the smaller connectors.

In order to minimize the problem of aligning electrical connectors during mating, it has been proposed to mount one or both of the connectors in its respective support structure by means of a floating mount which allows the connector housing to "float" relative to the support structure. In other words, the connector housing is provided with a degree of movement relative to the support structure so that it is easier to align and mate a second connector therewith. Unfortunately, many floating mounts end up with the entire connector being moveable relative to its support structure which, causes the connector to become extremely loose and subject to too extreme movement. Also there was a need to provide an easily insertable floating blind mate connector having polarizing means.

The present invention is directed to providing a system for mounting an electrical connector in a support structure wherein a mating portion of the connector can float relative to the support structure, but the connector otherwise is fairly rigidly mounted in the support structure and is polarized.

SUMMARY OF THE INVENTION

An object, therefore, of the invention is to provide a new and improved system for mounting an electrical connector in a support structure.

In the exemplary embodiment of the invention, the connector includes a housing having a forward insertion end and a rearward mating end. The support structure includes an inner opening for receiving the forward insertion end of the housing and an outer opening for embracing the rearward mating end of the housing. Generally, first complementary interengaging mounting means are provided between the housing and the support structure at the outer opening for providing limited floating movement of the mating end of the housing relative to the support structure to facilitate mating the connector with a complementary connector. Second complementary interengaging mounted means are provided between the housing and the support structure at the inner opening for fixing the insertion end of the housing against movement relative to the support structure in at least two different directions.

As disclosed herein, the first complementary interengaging mounting means include a pair of flexible arms cantilevered from opposite sides of the housing and engageable with opposite sides of the outer opening of the support structure. The second complementary interengaging mounting means is provided by the inner opening having spaced flat side walls engaging opposite flat sides of the insertion end of the housing to prevent movement of the insertion end of the housing at least in directions perpendicular to the flat side walls of the opening.

The invention also contemplates the provision of a polarizing projection on the insertion end of the housing for engaging a polarizing surface on the support structure. The polarizing projection can be used to further prevent movement of the insertion end of the housing. In particular, the polarizing surface faces in a direction different from the aforesaid two different directions and, thereby, prevents movement of the insertion end of the housing relative to the support structure in a third direction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
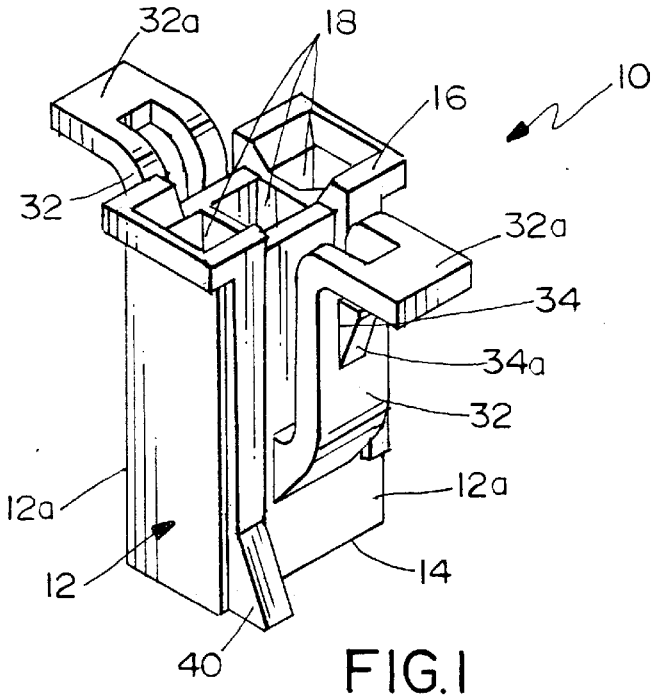
FIG. 1 is a perspective view of an electrical connector embodying the concepts of the invention.
Figure 2:
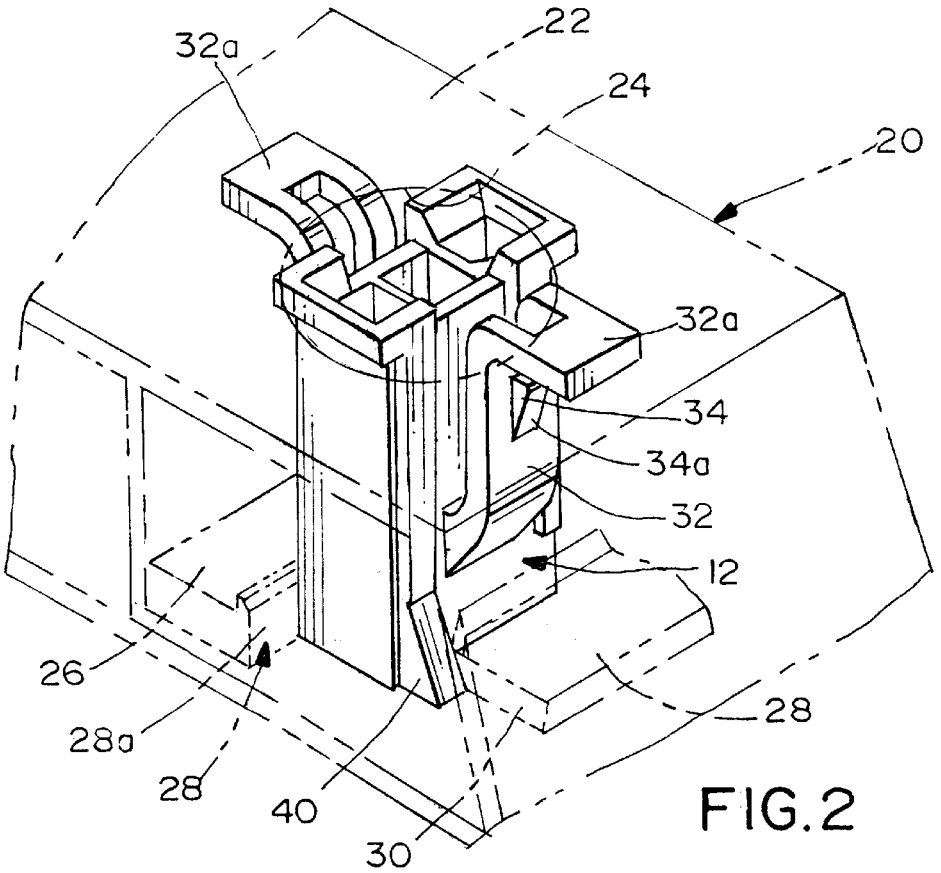
FIG. 2 is a perspective view of the connector mounted in a support structure embodying the concepts of the invention.
Figure 5:
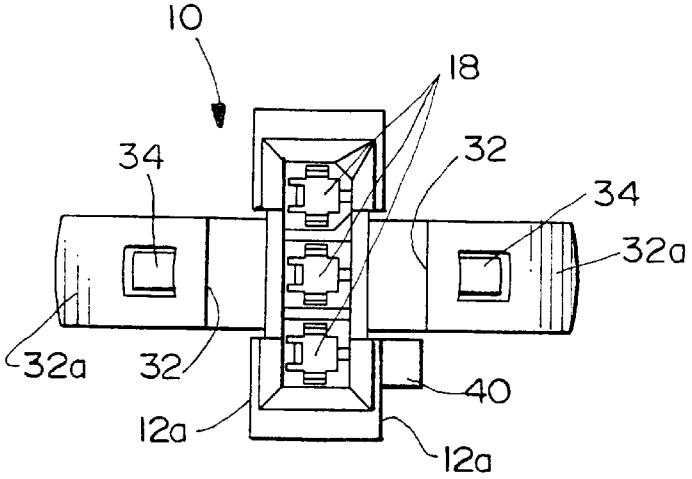
FIG. 5 is a bottom plan view of the connector, looking toward the bottom of FIG. 3.
Figure 6:
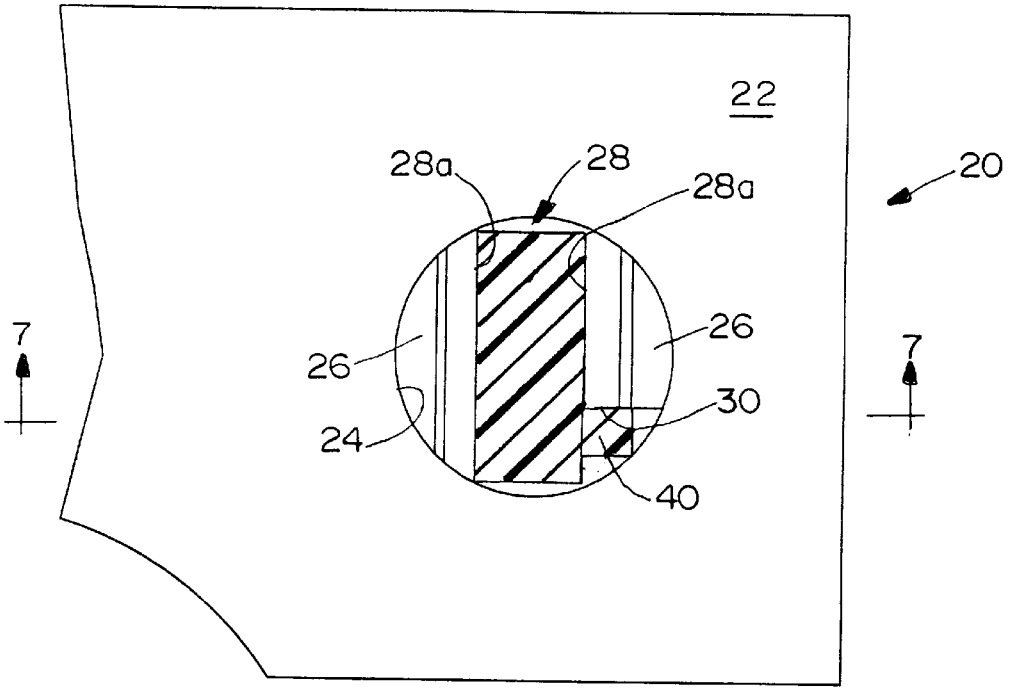
FIG. 6 is a fragmented top plan view looking down into the outer opening in the support structure, with a profile of the connector housing shown in section.
Figure 7:
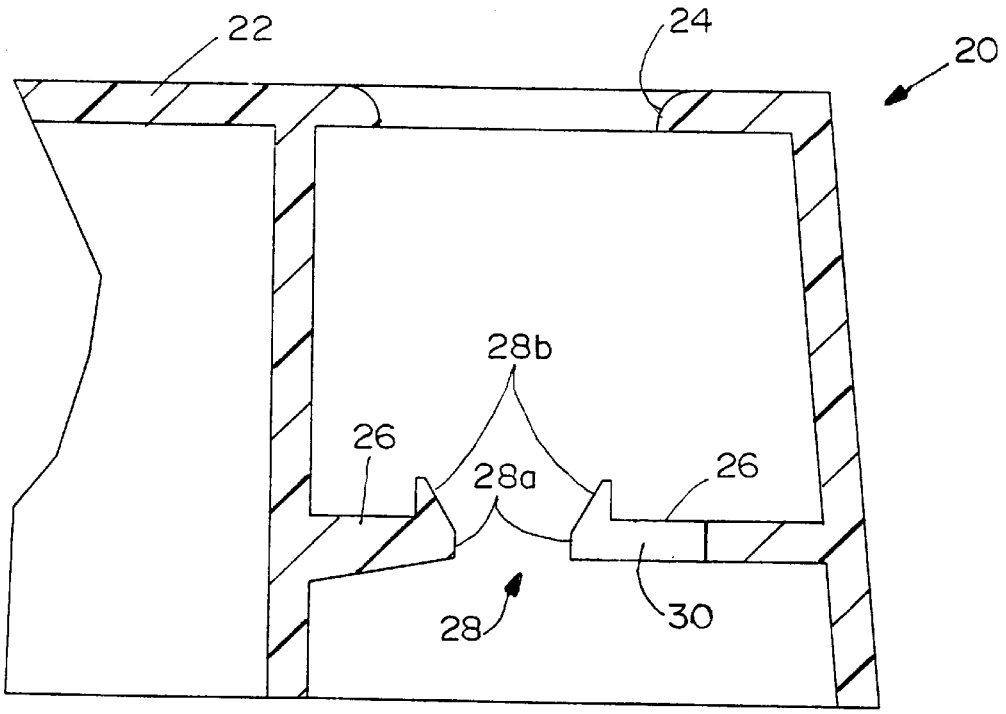
FIG. 7 is a vertical section taken generally along line 7—7 of FIG. 6.

Referring to the drawings in greater detail, FIGS. 1 and 3–5 show the electrical connector isolated from the support structure, FIG. 2 shows the connector mounted in the support structure and FIGS. 6 and 7 show details of the support structure.

More particularly, referring first to FIGS. 1 and 3–5, the invention is embodied in an electrical connector, generally designated 10, which includes a housing, generally designated 12, having a forward insertion end 14 and a rearward mating end 16. The housing is a one-piece structure molded of dielectric material such as plastic or the like. Three passages 18 (FIG. 5) extend lengthwise of housing 12 between insertion end 14 and mating end 16. The passages mount three conductive terminals (not visible in the drawings). The terminals have mating or interconnecting ends near mating end 16 of the housing for interconnection with the terminals of a complementary mating connector (not shown). The terminals have terminating ends near insertion end 14 of housing 12 for termination to the conductors of an electrical cable (not shown) as is known in the art.

Referring next to FIGS. 2, 6 and 7, the system of the invention includes a support structure, generally designated 20, into which connector housing 12 is inserted and mounted. In particular, the support structure includes a top panel or planar wall 22 having a circular mounting opening 24 therethrough. This opening defines the outer mounting opening of the support structure. The support structure further includes an interior wall 26 which is generally parallel to top wall 22. The inner wall has an elongated slot, generally designated 28, defined by a pair of straight or flat, generally parallel side walls 28*a* and angled portion 28*b*. Slot 28 defines an inner mounting opening of the support structure. It can be seen in FIG. 6 that the inner opening of the support structure defined by slot 28 intersects the outer opening of the support structure defined by circular opening 24 so that the circular opening and the elongated slot are aligned in an insertion direction of the connector. Lastly, referring to FIG. 6, inner wall 26 of the support structure has a shoulder 30 generally perpendicular to one of the side walls 28*a* of slot 28, for purposes described hereinafter.

Generally, a first complementary interengaging mounting means is provided between housing 12 and support structure 20 at outer opening 24 for providing limited floating movement of mating end 16 of the housing relative to the support structure. This facilitates mating of the connector with a complementary connector.

Figure 3:
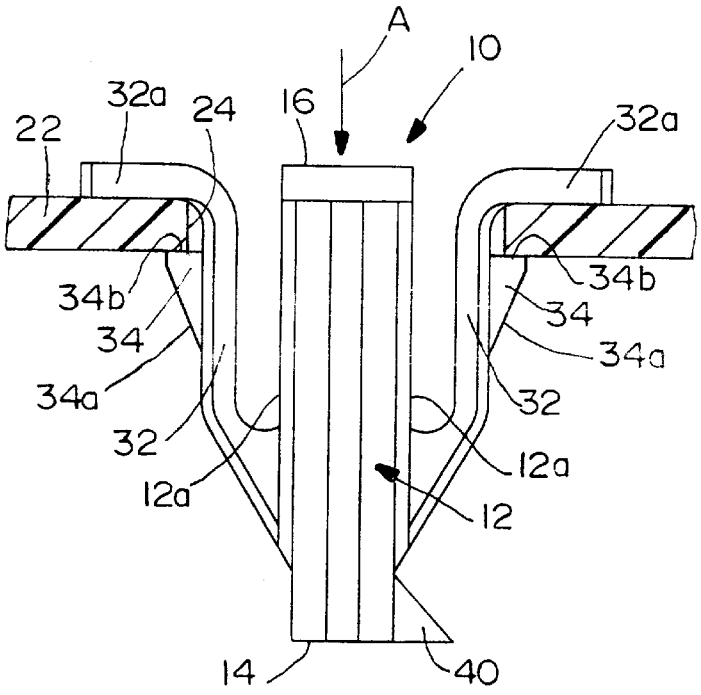
FIG. 3 is a side elevational view of the connector.
Figure 4:
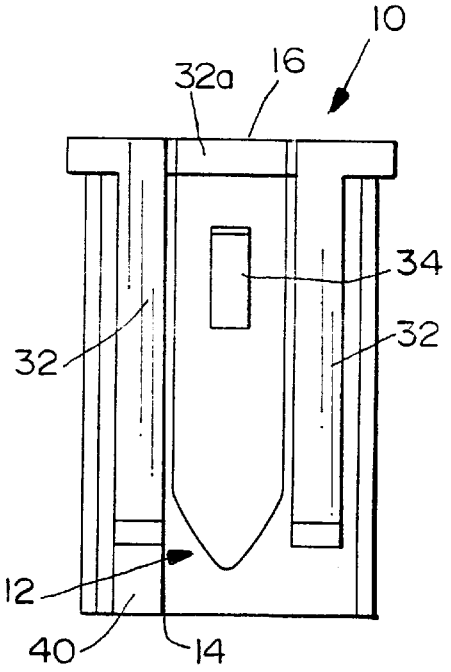
FIG. 4 is a side elevational view of the connector taken 90° relative to that of FIG. 3.

In particular, the first complementary interengaging mounting means includes a flexible latch arm 32 cantilevered from each opposite side 12*a* of housing 12. The latch arms have latch hooks 32*a* at the distal ends thereof. As best seen in FIG. 3, the latch hooks project outwardly of the housing generally perpendicular to the latch arms. A latch boss 34, having a leading chamfered surface 34*a* and a trailing abutment surface 34*b*, projects outwardly from each latch arm 32 as best seen in FIG. 3.

In mounting connector 12 into support structure 20, insertion end 14 of connector housing 12 is inserted through opening 24 in top wall 22 of the support structure as indicated by arrow "A" (FIG. 3). As the housing is inserted, leading chamfered surfaces 34*a* of latch bosses 34 engage the edges of opening 24 and bias latch arms 32 inwardly toward each other. Upon final movement of the housing into opening 24, latch hooks 32*a* will abut the top surface of top wall 22 of the support structure while, at the same time, latch bosses 34 will clear the opening and allow the latch arms to snap back outwardly under their own resiliency to sandwich top wall 22 between abutment surfaces 34*b* of latch bosses 34 and the underside of latch hooks 32*a* of latch arms 32. This is clearly shown in FIG. 3.

Generally, second complementary interengaging mounting means are provided between housing 12 and support structure 20 at inner opening 28 of the support structure for fixing insertion end 14 of the housing to the support structure. Angled portion 28*b* helps to locate the insertion end 14 of the housing into the inner opening 28. Once fully inserted the second complementary interengaging mounting means prevents movement of the insertion end of the housing relative to the support structure in at least two different directions.

In particular, the width of housing 12 between opposite sides 12*a* thereof at insertion end 14 thereof is slightly smaller than the distance between flat side walls 28*a* of inner slot 28 of the support structure. This can be seen best by the sectioning of the housing profile in FIG. 6. Therefore, the insertion end of the connector housing is fixed against movement relative to the support structure in the two opposite directions perpendicular to flat side walls 28*a* of slot 28.

Electrical connector 10 further includes a polarizing projection 40 projecting transversely of only one of the sides 12*a* of the housing, namely the right-hand side as viewed in FIGS. 3 and 5. This polarizing projection is generally rectangular in cross-section and is located at a corner of the housing. When the connector is mounted in support structure 20, the connector housing can be inserted to its final position only if polarizing projection 40 projects alongside shoulder 30 of inner wall 26 of the support structure as shown in FIGS. 2 and 6. With this construction, not only does the polarizing projection polarize the orientation of the connector, but the engagement of the polarizing projection with shoulder 30 of inner wall 26 of the support structure further fixes the insertion end of the connector against movement relative to the support structure in a third direction, i.e. the direction of abutment between the polarizing projection and shoulder 30.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A system for mounting an electrical connector in a support structure, comprising:

said electrical connector including a housing having a forward insertion end and a rearward mating end;

said support structure including an inner opening for receiving the forward insertion end of the housing and an out opening for embracing the rearward mating end of the housing;

first complementary interengaging mounting means between the housing and the support structure at said outer opening for providing limited floating movement of the mating end of the housing relative to the support structure to facilitate mating of the connector with a complementary connector; and second complementary interengaging mounting means between the housing and the support structure at said inner opening for fixing the insertion end of the housing against movement relative to the support structure in at least two different directions.

2. The system of claim 1 wherein said inner opening comprises a slot and said outer opening is generally circular.

3. The system of claim 1, including a polarizing projection on the insertion end of the housing for engaging a polarizing surface on the support structure.

4. The system of claim 3 wherein said polarizing surface faces in a direction different from said two different directions and, thereby, prevents movement of the insertion end of the housing relative to the support structure in a third direction.

5. The system of claim 1 wherein said first complementary interengaging mounting means include at least one flexible latch arm cantilevered from a side of the housing and engageable in said outer opening.

6. The system of claim 5, including a pair of said flexible latch arms cantilevered from opposite sides of the housing and engageable with opposite sides of said outer opening.

7. The system of claim 1 wherein said second complementary interengaging mounting means comprises said inner opening having spaced flat side walls engaging flat sides of said insertion end of the housing.

8. A system for mounting an electrical connector in a support structure, comprising:

said electrical connector including a housing having a forward insertion end and a rearward mating end;

said support structure including an inner opening for receiving the forward insertion end of the housing and an outer opening for embracing the rearward mating end of the housing;

a pair of flexible latch arms cantilevered from opposite sides of the housing and engage able with opposite sides of said outer opening for providing limited floating movement of the mating end of the housing relative to the support structure to facilitate mating of the connector with a complementary connector; and said inner opening of the support structure having spaced flat side walls engaging flat sides of the insertion end of the housing for fixing the insertion end of the housing against movement relative to the support structure in at least two different directions.

9. The system of claim 8 wherein said outer opening is generally circular.

10. The system of claim 8, including a polarizing projection on the insertion end of the housing for engaging a polarizing surface on the support structure.

11. The system of claim 10 wherein said polarizing surface faces in a direction generally perpendicular to said flat side walls of said inner opening and, thereby, prevents movement of the insertion end of the housing relative to the support structure in a third direction.

12. An electrical connector to be mounted in a support structure, said support structure including an inner opening and an outer opening, comprising:

a housing having a forward insertion end adapted to be received in the inner opening and a rearward mating end adapted to be embraced by the outer opening;

first complementary interengaging mounting means between the housing and the support structure at said outer opening for providing limited floating movement of the mating end of the housing relative to the support structure to facilitate mating of the connector with a complementary connector; and second complementary interengaging mounting means between the housing and the support structure at said inner opening for fixing the insertion end of the housing against movement relative to the support structure in at least two different directions.

13. The electrical connector of claim 12, including a polarizing projection on the insertion end of the housing for engaging a polarizing surface on the inner opening of the support structure.

14. The electrical connector of claim 13 wherein said polarizing surface faces in a direction different from said two different directions and, thereby, prevents movement of the insertion end of the housing relative to the support structure in a third direction.

15. The electrical connector of claim 12 wherein said first complementary interengaging mounting means include at least one flexible latch arm cantilevered from a side of the housing and engageable in said outer opening.

16. The electrical connector of claim 15, including a pair of said flexible latch arms cantilevered from opposite sides of the housing and engageable with opposite sides of said outer opening.

* * * * *